US005485782A

United States Patent [19]

Van Der Horst

[11] Patent Number: 5,485,782

[45] Date of Patent: Jan. 23, 1996

[54] APPARATUS FOR PRINTING PROOFS

[75] Inventor: Hans Van Der Horst, Rijnsaterwoude, Netherlands

[73] Assignee: AV Flexologic B.V., Alphen A/D Rijn, Netherlands

[21] Appl. No.: 402,178

[22] Filed: Mar. 13, 1995

[30] Foreign Application Priority Data

Mar. 14, 1994 [NL] Netherlands ..... 9400397

[51] Int. Cl.[6] ..... B41F 5/00

[52] U.S. Cl. ..... 101/216; 101/247; 101/DIG. 36

[58] Field of Search ..... 101/216, 218, 101/136, 141, 153, 247, 248, 174, 175, 176, 178, DIG. 36, 219, 486

[56] References Cited

U.S. PATENT DOCUMENTS

| | | | |
|---|---|---|---|
| 4,004,509 | 1/1977 | Moss | 101/216 |
| 4,019,434 | 4/1977 | Hoexter | 101/216 |
| 4,852,486 | 8/1989 | Ely et al. | 101/247 |
| 4,936,211 | 6/1990 | Pensacvecchia et al. | 101/136 |
| 4,936,212 | 6/1990 | Moss | 101/216 |
| 5,065,677 | 11/1991 | Leader, Jr. et al. | 101/389.1 |
| 5,132,911 | 7/1992 | Leader et al. | 101/DIG. 36 |
| 5,163,368 | 11/1992 | Pensavecchi et al. | 101/136 |
| 5,331,893 | 7/1994 | Wieland | 101/486 |
| 5,377,590 | 1/1995 | Bolza-Schunemann | 101/389.1 |

FOREIGN PATENT DOCUMENTS

| | | |
|---|---|---|
| 0352483 | 1/1990 | European Pat. Off. . |
| 2550730 | 2/1985 | France . |
| 2550995 | 3/1985 | France . |

OTHER PUBLICATIONS

A. Ritz, "die druckabwicklung im flexodruk", Papier & Kunstoff Verarbeiter, part 126, No. 6, 1991, Franfurt am Main, pp. 52–58.

*Primary Examiner*—Eugene H. Eickholt
*Attorney, Agent, or Firm*—Banner & Allegretti, Ltd.

[57] ABSTRACT

Apparatus for printing onto a substrate printing plates manufactured from flexible material, comprising: a frame; a forme cylinder mounted in the frame and adapted to receive the printing plate; a counter-pressure cylinder mounted in the frame; a guide for carrying the substrate for printing between the forme cylinder and the counter-pressure cylinder; a drive for driving the forme cylinder and the counter-pressure cylinder, wherein the drive is adapted to drive the forme cylinder and the counter-pressure cylinder at a different peripheral speed.

9 Claims, 2 Drawing Sheets

APPARATUS FOR PRINTING PROOFS

Figure 1:
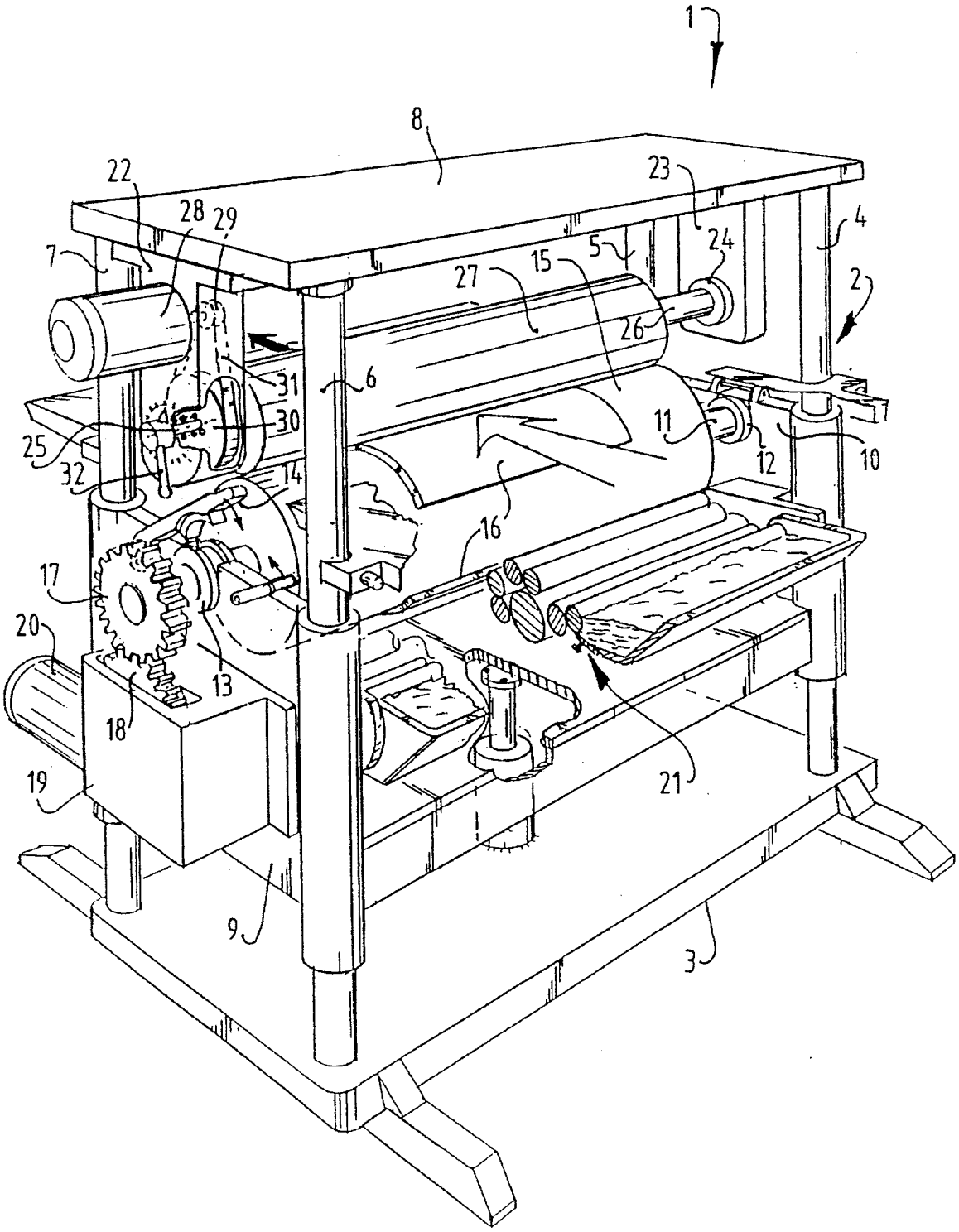

The invention relates to an apparatus for printing onto a substrate printing plates manufactured from flexible material, comprising:

a frame;

a forme cylinder mounted in the frame and adapted to receive the printing plate;

a counter-pressure cylinder mounted in the frame;

guide means for carrying the substrate for printing between the forme cylinder and the counter-pressure cylinder;

drive means for driving the forme cylinder and the counter-pressure cylinder.

Such apparatus is generally known in the form of flexo printing machines.

These are large machines which are adapted for mass printing of flexible printing plates. There exists a need however for printing machines of simpler form which are suitable for making proofs or printing single items, for example up to a maximum of ten items.

Due to the fact that in such proof printing apparatus the printed number is always small, the setting time takes up a large part of the time such a printing machine is used. A great amount of time is therefore saved by always making use of the same forme cylinder to prevent continuous changing of the forme cylinder. It should be noted here that in such a proof printing apparatus flexible printing plates must usually be printed which are intended for printing on forme cylinders of widely varying diameter. A flexible printing plate extends generally, although not per se necessarily, over the whole cylinder surface periphery of a forme cylinder.

It therefore saves time in the case of a proof printing apparatus when flexible printing plates suitable for printing on forme cylinders of differing diameter are always printed on the same forme cylinder. This entails a problem, however; a flexible printing plate has a certain thickness, so that when the flexible printing plate is fixed on a forme cylinder the periphery on the outside of the flexible printing plate is slightly larger than on the inside of the flexible printing plate (corresponding with the periphery of the forme cylinder). A deforming of the flexible printing plate thus takes place, this such that the outside, with which the print is made, is stretched slightly in tangential direction. This deformation is taken into account in the production of the flexible printing plate.

When however the flexible printing plate is fixed onto a forme cylinder with a diameter which does not correspond with the diameter for which the flexible printing plate is intended, a different deformation takes place. This situation occurs in the proof printing installation.

The object of the present invention is to provide such an apparatus wherein the above stated deformation is avoided.

This object is achieved in that the apparatus is provided with drive means which are adapted to drive the forme cylinder and the counter-pressure cylinder at a different peripheral speed.

Assuming the situation where the forme cylinder is driven at the nominal speed and the flexible printing plate is intended for a forme cylinder with a smaller diameter, the flexible printing plate is fixed on the proof printing machine on a cylinder with a large diameter; stretching of the image of the flexible printing plate for printing is thus less than that taken into account in the manufacture of the flexible printing plate. In order to compensate this the counter-pressure cylinder is driven at a higher speed so that the substrate on which the proof must be made moves more rapidly, whereby the too small stretching of the image of the flexible printing plate for printing is compensated.

Figure 2:
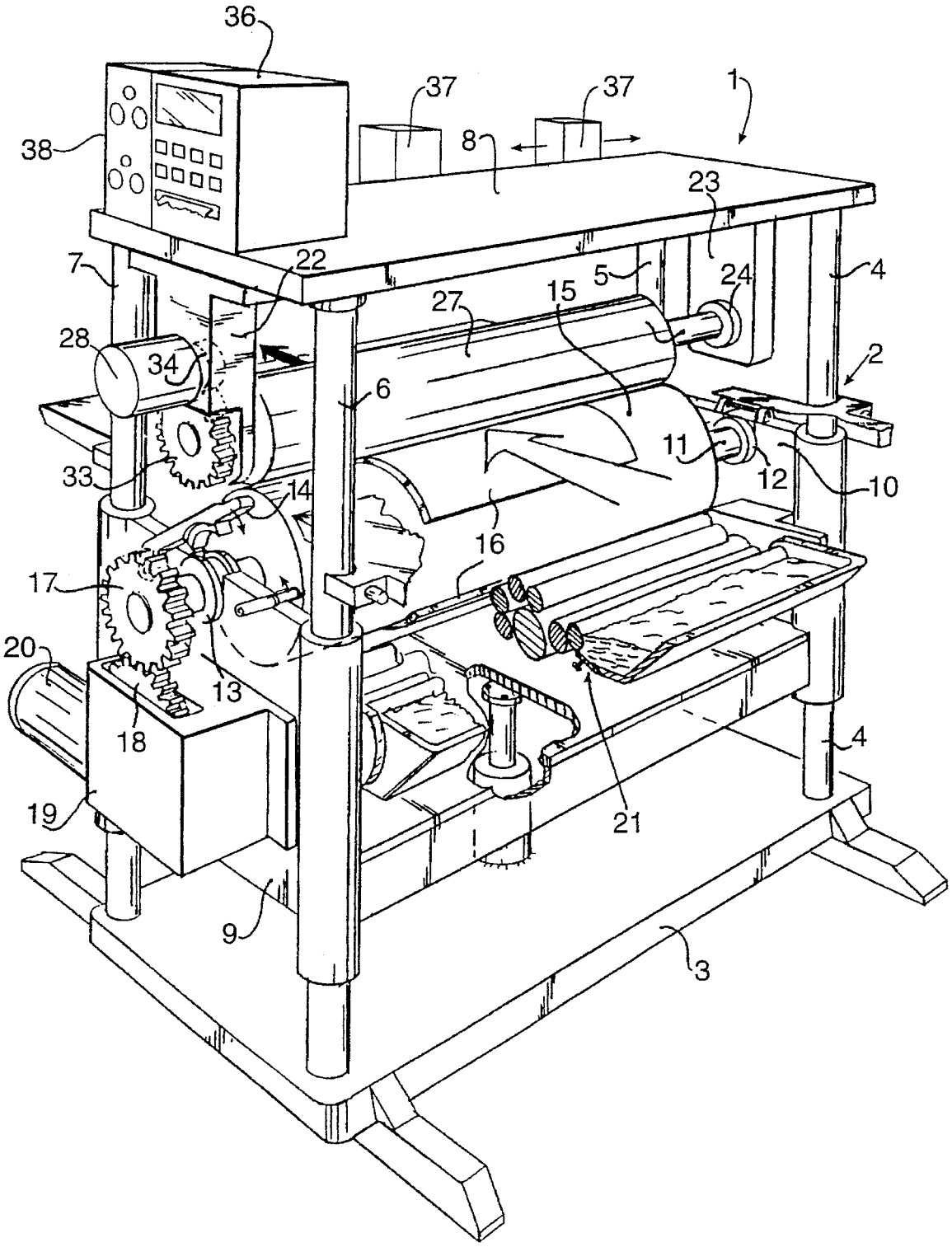

Other attractive embodiments of the invention will be round in the following description. The invention will now be elucidated with reference to the annexed drawings, in which:

FIG. 1 shows a partly broken away perspective view of a first embodiment of the present invention; and FIG. 2 shows a partly broken away perspective view of a second embodiment of the present invention.

Depicted in FIG. 1 is a proof printing apparatus 1 which is formed by a frame 2 which is mounted on a foot 3. The frame comprises four upward extending rods 4,5,6,7 which are connected at their top by a top plate 8. Between each pair of rods 4,5 respectively 6,7 is arranged a mounting plate 9 respectively 10 in which a forme cylinder shaft 11 is mounted by means of bearings 12 respectively 13. The forme cylinder shaft 11 is normally locked into plate 9 by means of a bracket 14 connected hingedly to mounting plate 9. The shaft can be taken out by releasing the bracket 14.

Fixed to the forme cylinder shaft 11 is a forme cylinder 15 on which is fixed a flexible printing plate 16 for printing. Arranged on the shaft to the outside of bearing 13 is a tooth wheel 17 which engages with a drive gear wheel 18 which forms part of a reduction gear unit 19. The latter is otherwise fixed to the mounting plate 9. Arranged against mounting plate 9 is an electric motor 20 which drives the reduction gear unit 19.

For inking of the flexible printing plate 15 fixed onto the forme cylinder 15 an inking unit is arranged which is designated as a whole by 21 and which is not further discussed since it is of no significance for the present invention. Such inking unit is otherwise generally known.

Fastened to the top plate 8 is a pair of fixing brackets 22,23 in which bearings 24 and 25 respectively are arranged and in which a counter-pressure cylinder shaft 26 is mounted. A counter-pressure cylinder 27 is fixed to the counter-pressure cylinder shaft 26.

Use is made for driving of the counter-pressure, cylinder of an electric motor 28 which is fixed to the bracket 22 and to the output shaft of which a pulley 29 is attached, and of a pulley 30 attached to the counter-pressure cylinder shaft. A belt 31 is trained round pulley 29 and pulley 30.

The width of the pulley 30 can be varied by means of a lever 32 so that the effective periphery of pulley 30 can be varied, and at a constant rotation speed of the motor 28 the rotation speed of the counter-pressure cylinder 27 can be varied with the lever 32.

The operation of the apparatus shown in FIG. 1 will be described hereinbelow.

In order to make a proof the flexible printing plate is first fixed in register on the forme cylinder 15, using for instance a device which is described in the Netherlands patent application number 8800416. However, according to a preferred embodiment of the invention a positioning device 37 is arranged on the frame which is formed by cameras which are provided with a cross wire and which can be adjusted to a predetermined position. The cross wires make it possible to place in register reference marks arranged on the flexible printing plate and therewith the flexible printing plates. As can be seen in FIG. 1, the flexible printing plate does not extend over the whole periphery of the forme cylinder 15. It could appear herefrom that the flexible printing plate 16 is suitable for printing using a forme cylinder of smaller diameter, so that the diameter of the forme cylinder 15 now in use is too large. As a result the stretching on the printing side of the flexible printing plate 16 is less than has been taken into account in the manufacture of the flexible printing plate.

The inking unit 21 is subsequently placed in position and via feed means not shown in the drawing a substrate is supplied on which the flexible printing plate must be printed. The electric motors 20 and 28 are then switched on so that the forme cylinder 15 will begin to rotate, as will the counter-pressure cylinder 27. Herein the rotation speed of counter-pressure cylinder 27, which can be varied by turning the lever 32, is chosen such that the peripheral speed of counter-pressure cylinder 27 is slightly greater than the peripheral speed of the flexible printing plate 16 attached to the forme cylinder 15. The substrate is fed through between both rollers, wherein a print is made. The print can then be viewed and on the basis of the results thereof a new print can be made with a modified rotation speed, i.e. speed of revolution of the counter-pressure cylinder 27, which process can be repeated until a satisfactory proof is obtained.

It will further be seen that the rotation speed of the counter-pressure cylinder is selected to be a determined percentage higher than the peripheral speed of the forme cylinder, which percentage is approximately equal to the ratio between the diameters of the forme cylinder for which the flexible printing plate is intended and the actual forme cylinder of the proof printing apparatus.

FIG. 2 shows another embodiment of a proof printing apparatus according to the invention. The proof printing apparatus shown in FIG. 2 differs from the proof printing apparatus shown in FIG. 1 in the fact that the drive between the electric motor 28 and the counter-pressure cylinder shaft 26 has been changed. To the outside of bracket 22 a tooth wheel 33 is arranged on the counter-pressure cylinder shaft 26, which wheel engages with a tooth wheel 34 which forms part of a reduction gear unit 35 fixed against the bracket 22.

Both electric motors 20 and 28 are powered by a frequency converter 36 which is fixed on the top plate 8 of the proof printing apparatus 1. Using the frequency converter 36 the rotation speeds, or the peripheral speeds of the counter-pressure cylinder and of the forme cylinder, can be chosen completely freely.

It is even possible to make use for control of the frequency converter of a computer 38, in which the data of the flexible printing plates for printing are input and wherein the computer calculates the correct speeds on the basis of this data.

I claim:

1. Apparatus for printing onto a substrate printing plates manufactured from flexible material, comprising:

a frame;

a forme cylinder mounted in the frame and adapted to receive the printing plate;

a counter-pressure cylinder mounted in the frame;

guide means for carrying the substrate for printing between the forme cylinder and the counter-pressure cylinder;

drive means for driving the forme cylinder and the counter-pressure cylinder, characterized in that the drive means are adapted to drive the forme cylinder and the counter-pressure cylinder at a different peripheral speed.

2. Apparatus as claimed in claim 1, characterized in that the drive means are adapted to drive the guide means.

3. Apparatus as claimed in claim 1, characterized in that the drive means comprise:

a first electric motor for driving the forme cylinder;

and a second electric motor for driving the counter-pressure cylinder.

4. Apparatus as claimed in claim 3, characterized in that the second electric motor is adapted to drive the guide means.

5. Apparatus as claimed in claim 1, characterized in that the drive means are adapted to vary the rotation speed of the forme cylinder or the counter-pressure cylinder.

6. Apparatus as claimed in claim 3, characterized in that the drive means comprise an electronic rotation speed controller for powering the respective electric motors.

7. Apparatus as claimed in claim 6, characterized in that the apparatus comprises a computer which is adapted to control the electronic rotation speed controllers.

8. Apparatus as claimed in claim 7, characterized in that the computer is adapted to control the ratio between the rotation speed of both electric motors.

9. Apparatus as claimed in claim 1, characterized in that means are arranged for positioning the flexible printing plate on the forme cylinder.

* * * * *